US007913597B2

(12) United States Patent
Gambini

(10) Patent No.: US 7,913,597 B2
(45) Date of Patent: Mar. 29, 2011

(54) MACHINE FOR THE AUTOMATIC RECOVERY OF PAPER AND TUBE SEPARATED FROM CUTTING SCRAPS INTO ROLLS OF LOGS OR THE LIKE

(75) Inventor: Giovanni Gambini, Pisa (IT)

(73) Assignee: Gambini International S.A., Luxembourg (LU)

( * ) Notice: Subject to any disclaimer, the term of this patent is extended or adjusted under 35 U.S.C. 154(b) by 1249 days.

(21) Appl. No.: 11/492,527

(22) Filed: Jul. 25, 2006

(65) Prior Publication Data

US 2007/0022854 A1 Feb. 1, 2007

(30) Foreign Application Priority Data

Jul. 28, 2005 (IT) ..... MI2005A1466

(51) Int. Cl.
*B26D 7/00* (2006.01)

(52) U.S. Cl. ..... 83/102; 83/102.1; 83/167; 83/924

(58) Field of Classification Search ..... 83/167, 83/13, 102, 154, 924, 267, 89, 368, 435.2, 83/446, 508.2, 862, 102.1; 82/91, 83, 42, 82/53, 53.1, 70.2, 1.11, 113
See application file for complete search history.

(56) References Cited

U.S. PATENT DOCUMENTS

| | | | | |
|---|---|---|---|---|
| 3,245,302 | A * | 4/1966 | Bayley | 83/614 |
| 3,577,889 | A * | 5/1971 | Eriksen | 83/863 |
| 3,911,768 | A * | 10/1975 | Kawano | 82/86 |
| 5,367,930 | A * | 11/1994 | Lemley | 83/368 |
| 5,453,070 | A * | 9/1995 | Moody | 493/288 |
| 5,972,153 | A * | 10/1999 | Focke et al. | 156/256 |
| 6,718,853 | B2 * | 4/2004 | Butterworth | 82/91 |
| 7,080,738 | B2 * | 7/2006 | Gambini | 209/620 |
| 2004/0074350 | A1 * | 4/2004 | Hanada | 82/1.11 |

FOREIGN PATENT DOCUMENTS

| | | |
|---|---|---|
| CH | 687 822 A | 2/1997 |
| EP | 1 231 320 A | 8/2002 |

OTHER PUBLICATIONS

European Search Report, Nov. 6, 2006.

* cited by examiner

*Primary Examiner* — Ghassem Alie
(74) *Attorney, Agent, or Firm* — Hedman & Costigan, PC; James V. Costigan

(57) ABSTRACT

A machine for the recovery of white cellulose paper from a trimming roll of white cellulose paper on a cardboard core where the machine has a conveyor belt on which the trimming rolls are arranged with the axis vertical, and the trimming rolls are inserted on a guide bar which, with appropriate actuators, cuts the rolls while the cardboard core is retained on the bar and the paper is allowed to fall and sent to recovery.

6 Claims, 4 Drawing Sheets

MACHINE FOR THE AUTOMATIC RECOVERY OF PAPER AND TUBE SEPARATED FROM CUTTING SCRAPS INTO ROLLS OF LOGS OR THE LIKE

FIELD OF THE INVENTION

The present invention refers to a machine intended to separate and recover the pure cellulose paper contained in trimming rolls or selvage obtained from the cutting of paper reels in the production of cellulose paper for domestic or sanitary use.

BACKGROUND OF THE INVENTION

At the present time, there are no known devices in the prior art which may safely carry out a process for the separation of paper from the cardboard inner tube of logs or the like of toilet paper and/or paper towels that are manufactured for domestic use. Such difficulty arises from the fact that there are intrinsic diversities of the tube including various diameters and various lengths. These rolls, which are trimmings or side discards or remains from the precise cutting of an actual log or roll having a substantially constant diameter. These trimmings, also called selvages, may be of two or three sizes, but of uncertain length and for this reason it has been preferred to work these remnants by hand, given the considerable value of cellulose-rich white paper remnants which may be recycled for the actual production of new material.

An object of the present invention is therefore that of resolving the problems related to the recovery of both the paper and the cardboard of any size and length, that are derived from an end or trimming and cutting operation.

These objects are achieved by the use of the machine described in the specification and in the claims attached to the present specification.

The machine of the invention, in addition to separating and recovering the paper and core from the cardboard inner tube of logs or the like of toilet paper and/or paper towels, executes a series of complementary preparation operations. Indeed, during the precise cutting operation of the paper rolls for domestic or sanitary use, the cutter conveys the pieces produced to the final packaging machines, while the trimmings, of uncertain length but largely similar to each other, are separated and normally sent to containers. According to the invention, the trimmings are conveyed to the principal conveyor of the machine of the present invention with simple conveyor belts or the like.

SUMMARY OF THE INVENTION

The first conveyor, in addition to moving the trimming rolls of the rolls, has a simple sorter composed of an adjustable-height belt arranged transversely to the conveyor, where the conveyor is placed on a surface at a height slightly greater than the length of the roll in order to permit the free passage of the vertical axis trimming rolls, and laterally move and therefore direct the superimposed or horizontal axis trimming rolls, which causes the trimming rolls to be knocked over.

Once the trimming rolls are arranged with their axis perpendicular to the conveyor belt, by means of movable and fixed lateral guides, the trimming rolls are conveyed, as in a flat funnel on two parallel and centered belts in line with two parallel and vertical roller conveyors. Once this course is terminated, which also operates by accumulation, two flat bands operated by actuators, which are preferably pneumatically activated by a precise command of a position reader of the trimming roll, cause the trimming roll to fall vertically, laterally and simultaneously off of the conveyor belt. In the fall, an "L"-shaped centering and guide pin with a well-matched corner is inserted into the hole of the cardboard core, until the trimming roll reaches a movable abutment which at the appropriate moment sends it toward the longitudinal cutting blade.

The cutter is composed of a blade arranged vertically on the upper horizontal generatrix of the centering pin of the trimming roll and both the blade and a belt parallel to said pin to linearly feed the trimming roll onto a cutting guide bar. At this point, after the blade cuts the trimming roll there is the separation of the paper wrapped around the core and the cardboard of the core: indeed, the cardboard, while cut, remains rolled up on the bar and will be pushed outside the machine, while the pure cellulose paper, just cut, opens up and even if slightly held by the belt falls downward. In such fall, the paper is taken by an appropriate suction pneumatic conveyor system and is recycled to production or to a temporary stockpile.

Thus a completely automatic cycle is provided by the cutting machine of trimming rolls for domestic use or the like, up until the recovery of the paper and its reuse if desired.

It is evident that the devices described here may also be substituted with other analogous devices while the cutting and recovery zone certainly remains as described may be changed by simple and unimportant modifications.

BRIEF DESCRIPTION OF THE SEVERAL VIEWS OF THE DRAWINGS

In the attached drawings, the various details of the machine are shown in an exemplifying and not limiting embodiment, in order to highlight the characteristics and advantages of a machine according to the invention.

DETAILED DESCRIPTION OF THE INVENTION

Figures 1, 2:
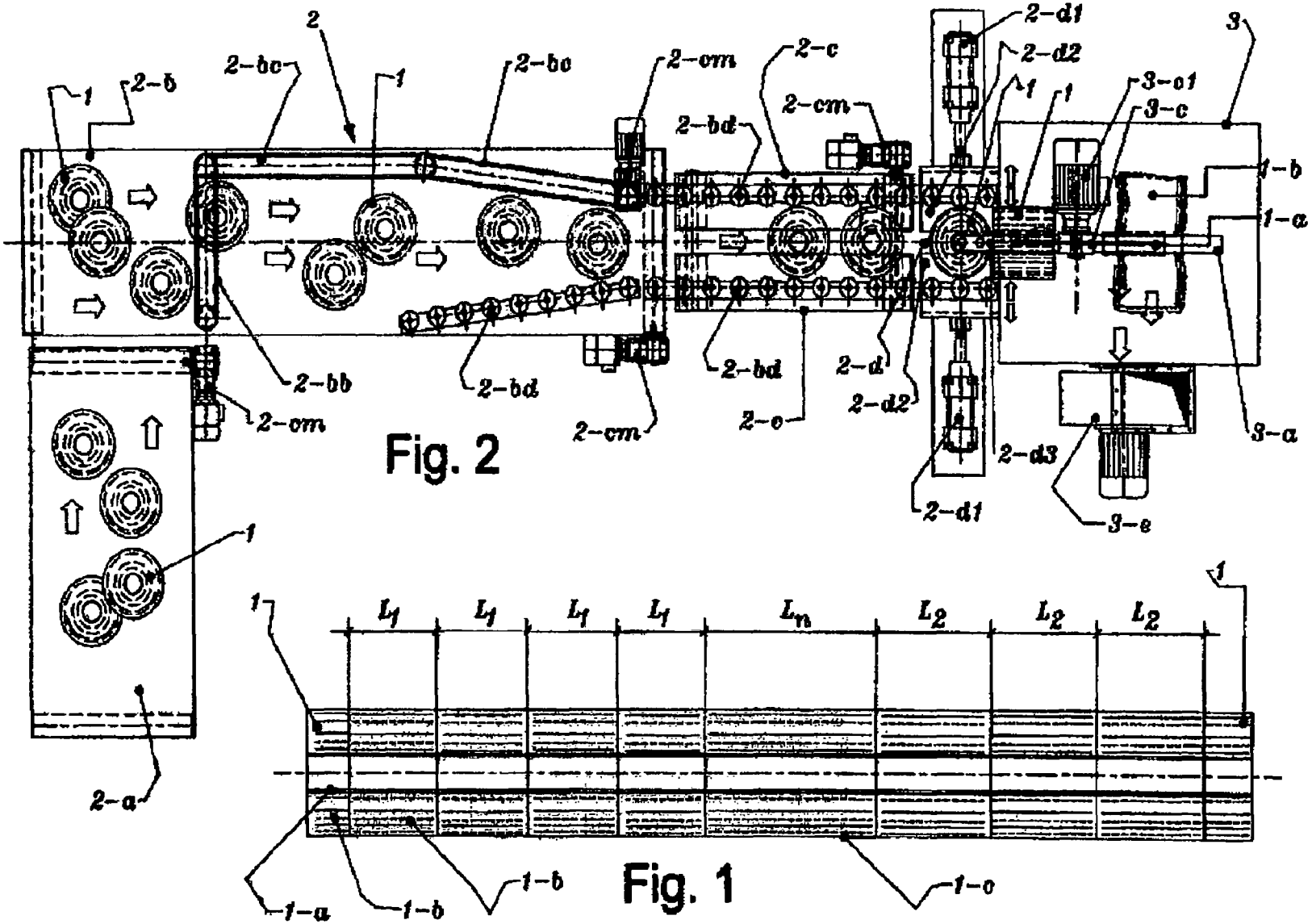
FIG. 1 is a section view of a log or long roll.
FIG. 2 is a plan view from above of a machine for the recovery of paper according to the invention.

The numbers and numbers with letters, point out the various elements and groups, as reported here below where 1 is a beginning or end scrap or trimming roll or discard roll or the like composed of a paper zone, generally pure cellulose intended for domestic or sanitary use and for this reason usually of good or optimal quality, wrapped around a cardboard tube of low quality and cost where 1-*a* indicates a cardboard tube on which paper of domestic or sanitary use is usually wrapped and such paper is usually composed of a series of helically wrapped layers to form the mentioned tube with characteristics of strength and lightness. Paper 1*b* for domestic or sanitary use is obtained by the overlapping of several preformed layers or other methods used for its production. Such paper is good-quality pure cellulose and is very often used for the first time and is therefore valuable for recycling. The parts of a log or long roll 1*c*, cut into various sizes, is produced of standard lengths depending on the production machines and then cut into small rolls, whose length is indicated here (L1, L2, etc.), for the previously mentioned domestic and sanitary uses. A schematic of an entire machine 2 is described which makes possible the automatic recovery of the paper 1-*b* coming from the end rolls of the cut or selvages of the initial main roll. The machine in its entirety is equipped with various operating accessories including a first conveyor belt 2*a* which conveys trimming rolls from a production/cutting machine of the rolls intended for sales. A second conveyor belt 2-*b* is provided, whose orientation and direction is according to the direction required for the recovery operations for which the machine 2 is intended. The conveyor belt 2-*b* has a considerable horizontal development, even if it is of limited length. A first belt 2-*bb* which is typically but not necessarily of circular section, is brought into movement by a motor, and it functions to sort the rolls 1 which may surmount others on the second conveyor belt 2-*b*, compelling them to have their cardboard tube axis vertical (as generic reference) or rather, both the cardboard tube 1-*a* and the paper 1-*b* are perpendicular to the belt. With regard to 2-*bc*, a second belt analogous to the first belt 2-*bb* is arranged slightly lower than the first belt 2-*bb*, and close to the second conveyor belt 2-*b*, in order to accompany/guide into aligned position 1 for the recovery operations; vertical axis idle rollers 2-*bd* or similar items, but also belts, may be utilized for the centering, with respect to the second flat conveyor belt 2-*b* or belts for conveying the various trimming rolls 1. The vertical axis idle rollers 2-*bd* operate as conveyors and aligners of the trimming rolls 1 and a pair of small belts 2-*c* is arranged parallel to the final preceding section of the feed device for feeding trimming rolls 1 to the cutting group, these small belts 2-*c* cooperating with two lines of rollers 2-*bd* placed parallel and in a containing fashion to convey the trimming rolls 1 toward the movable loading surfaces of the recovery machine or group 3. The various motor drives 2-*cm* of the belts and conveyor belts are provided, which are preferably but not necessarily of an electromechanical nature. Positioning and feeding zone 2-*d* is provided for the scrap rolls 1 which are sent to the paper separation and recovery machine 3. A pair of linear actuators 2*d*1 which are typically pneumatic are provided and a pair of horizontally movable surfaces 2-*d*2 are provided, which are brought into translation by linear actuators 2-*d*1 which are spaced from each other to allow trimming roll 1 to fall since the cardboard 1-*a* is inserted onto a curved cutting guide bar 3-*a* which operates as a trap door. A position and centering photoelectric reader 2-*d*3 of the trimming roll 1 is provided, which may also be provided with other types of feeler pins such as pneumatic or electromechanical feeler pins. A machine 3 for cutting and opening of trimming roll 1, and which is for the separation of the paper 1-*b* from the cardboard tube 1-*a* is provided with the consequent recovery of the paper or cellulose wads. The curved bar 3-*a* is provided, which is obtained from a tube of an appropriate diameter in relation with cardboard tubes 1-*a* that are to be received. The curved bar 3-*a* has a well-matched or radiated L shape and where it points towards 2-*d* it is equipped with a clear centering cone in order to facilitate the insertion of the cardboard tubes 1-*a*. A track 3-*a*1 is provided for the insertion of a cutting blade 3-*c* on the curved bar 3-*a*, and an appropriately sharp blade or knife support 3-*a*2 is provided, which is placed in line with the blade 3-*c* in order to permit the passage of the cardboard tube 1-*a* with minimum friction and the connection of the curved bar 3-*a* with the supporting structure of the machine in the zone indicated with 3. A linear actuator 3-*b*, which is preferably pneumatic, is equipped with a head cylinder for the one by one containment of the scrap rolls 1 in the guided descent of the scrap rolls 1 towards the cutting blade 3-*c*, in order to obtain all of the cuts in a very precise manner. The cutting blade 3-*c* of the trimming roll 1 is provided with the cutting edge arranged along the generatrix of the curved cutting guide bar 3-*a* in its horizontal section and also penetrates into the specific track 3-*a*1; said blade, for the cutting of paper and cardboard, has serrated teeth which rotate in the same direction as the advancing direction of the tube 1-*a*. A motor 3-*c*1 for the rotation of the cutting blade 3-*c* is provided; the rotation is quite fast in the case of paper and cardboard, and indeed said blade is generally directly coupled to an appropriate two-pole motor. A motorised belt 3-*d* is provided, which in its upper zone has same-direction motion as the trimming roll 1 and has a distance from 3-*a* depending on the thickness/thicknesses of the trimming rolls to be cut, vertically containing and supporting trimming roll 1, and facilitates the flaking off opening of the paper 1-*b* and simultaneously increases the support of the cardboard tube 1-*a* on the curved cutting guide bar 3-*a*. A motor 3-*d*1 is provided for the advancing of the motorised belt 3-*d* by means of a pair of pulleys, a driving pulley on the starter, and a tensioning pulley on the belt. A schematic suction structure 3-*e* of the paper 1-*b* cut in zone 3 is provided while the cardboard tube 1-*a* remains clinging to the bar 3-*a* until it moves outside the machine, which subsequently expels it.

Passing now to the details of the figures, in the attached FIGS. 1-5 it is quite easy to understand both the field of application and the operation of the present machine.

FIG. 1 shows a reel 1-*c* of paper already rolled up together, which is cut into different lengths depending on the final use, longer as for example L2 if intended for domestic use or in shorter rolls such as for example L1 for sanitary use.

The fact remains that in spite of how the reel of paper 1-*c* is cut, at the two ends, two trimming rolls 1 are produced, shorter than the others, which are commonly called trimmings or selvages, and are also composed of cellulose paper 1-*b* rolled on low-quality cardboard 1-*a* which obviously cannot be readmitted in the preparatory cycle of the cellulose layer since it would ruin the mixture used to make high quality paper. FIG. 2 shows a general plan view of the machine and the various conveyors-sorters of the trimming rolls 1. Starting from the left and following the arrows and the rolls 1, one may observe the sequence both of the course and the operations which along the way from the left to the right are carried out on the rolls 1 itself.

The first conveyor belt 2-*a* is placed here for exemplary use in order to indicate a generic origin from a machine of a previous process, in this case the cutting, which unloads here the various pieces 1 which are sent in bulk onto 2-*b*, the second conveyor belt, usually but not necessarily slightly ascending, where various trimming rolls may already have their axis vertical or else horizontal, or they may even be lying on other rolls and therefore slanting with respect to the second conveyor belt 2-*b*. A movable belt 2-*bb* of an appropriate height, moving the rolls with its own motion, causes them to be arranged with axis perpendicular to the belt, passing therefore under the movable belt 2-*bb*, and move toward the positioning zone 2-*d* for the insertion on the cutter 3; the operation of groups 2 and 3 will be more clearly explained in FIGS. 3, 4 and 5; exiting, finally, on the right side with respect to the advancing of the rolls a generic suction group is indicated which takes away the cellulose paper just cut in the cutting group 3.

Figure 3:
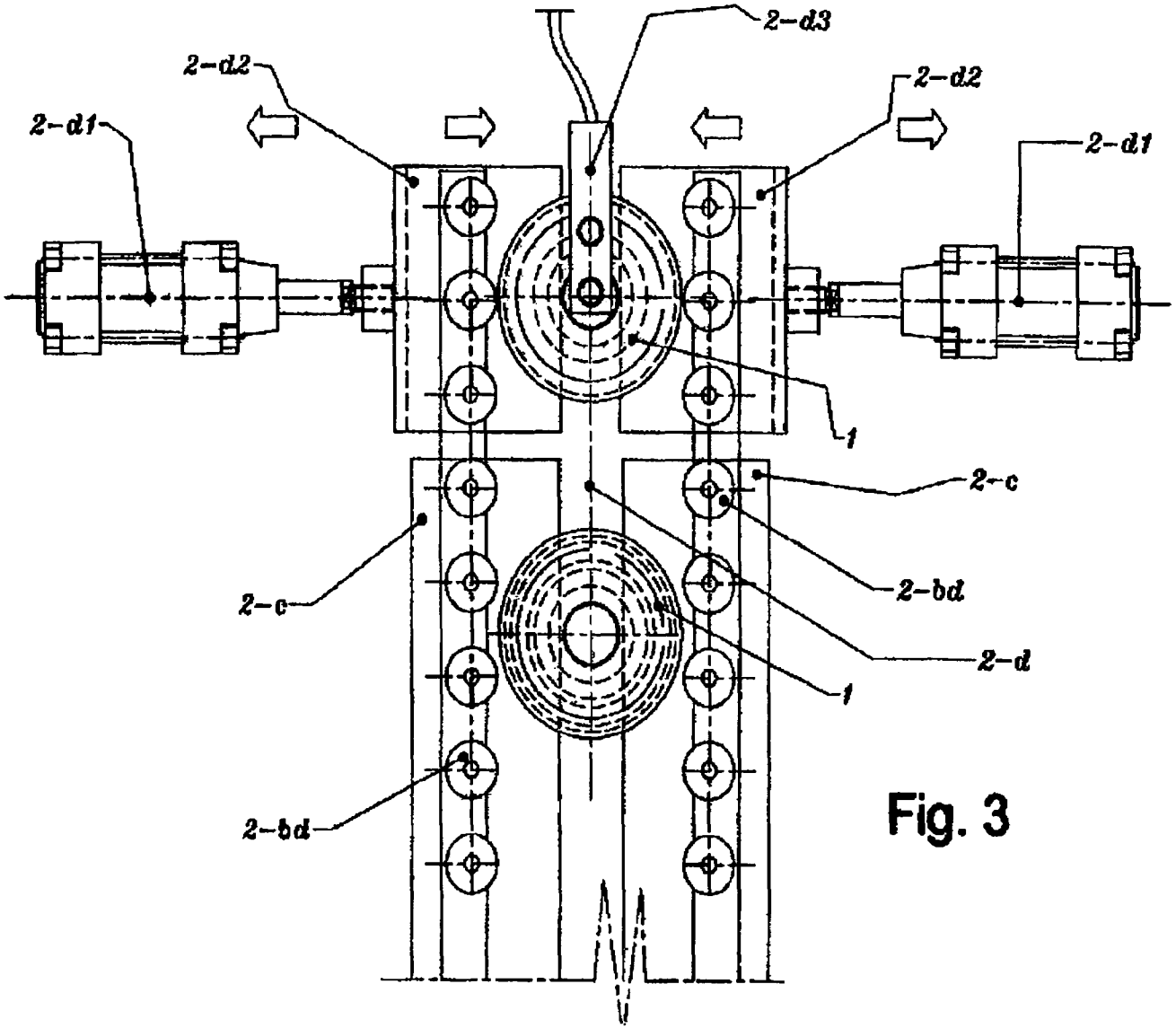
FIG. 3 is a plan view of an enlarged detail of FIG. 2 in a feeding zone of a single trimming roll or discard roll to a cutting zone.

The feed system of the rolls to the cutter represented in FIG. 3 will now be examined in detail, together with the cutting itself together with the various particular details necessary for its operation.

Indeed, FIG. 3 shows the pair of vertical rollers 2-*bd*, inside of which two trimming rolls 1 are represented, the first still on the small belts 2-*c* and in particular the second one which rests on the two movable surfaces or bands 2-*d*2 which may extend from and close toward the centre by means of the linear actuators 2-*d*1, opening as soon as the position reader 2-*d*3 gives 1 permission to pass into the cutting zone 3.

Figure 4:
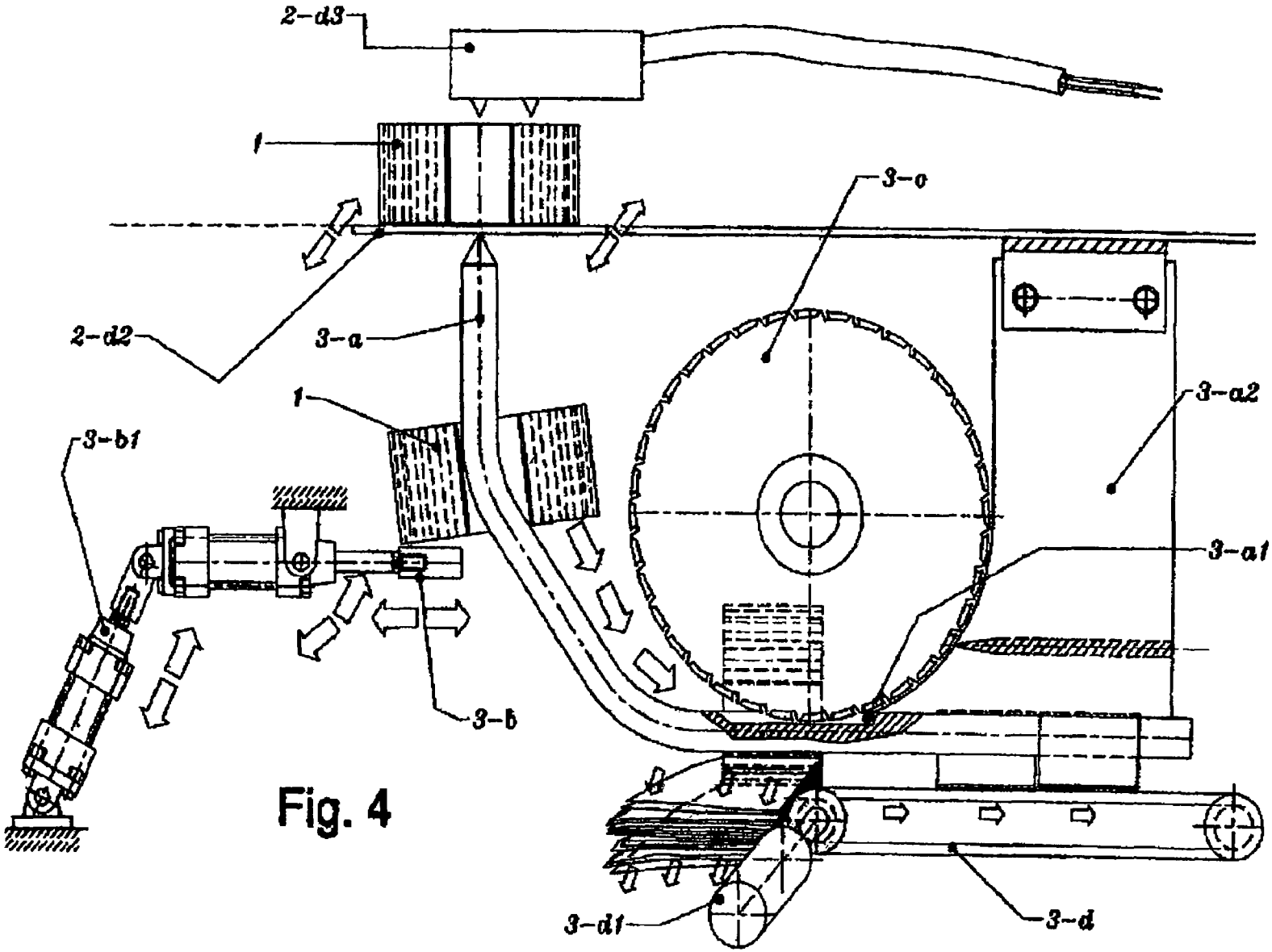
FIG. 4 is side elevation view, partially sectioned, of an enlarged detail of the zone of recovery and cutting of a trimming roll or discard roll.

The zone and operation characteristics of 3 are highlighted in FIG. 4, where to the left, under the position reader 2-*d*3, the roll 1 is situated; when the management system gives its permission, together with the position reader 2-*d*3, the movable bands 2-*d*2 open and one trimming roll 1 is inserted on the L-shaped curved bar 3-*a* and stops on the ledge of the actuator 3-*b*, which provides, returning and accompanying the trimming roll 1 with 3-*b*1, to send the trimming roll 1 itself by controlled fall under the blade 3-*c*, which has the cutting region inserted within the L-shaped curved bar 3-*a* for a secure cut and also to permit the sliding-advancing of the tubes 1-*a* on the curved bar 3-*a*.

With the cutting of all of the paper 1, along the generatrix of the cylinder constituting the roll, the paper 1-*b* itself tends immediately to open up or stretch out, leaving the tube 1-*a*, which instead proceeds, advancing towards the exit, still enclosed on the curved bar 3-*a* although cut and pushed ahead by the tubes (and rolls) arriving on the cutter but also driven towards the exit by the rotation direction of the blade 3-*c*.

In order to completely ensure the advancing motion of the rolls to the cutting under the cutting blade 3-*c* and with central guide 1-*a*, a belt 3-*d* was positioned, motorised by the starter of any power origin 3-*d*1; the circular section but also flat belt exerts a light pressure on the paper 1-*b* and simultaneously moving itself in the same direction as the trimming rolls 1 and the cardboard tubes 1-*a* favours its advancement toward the end of the curved bar 3-*a*, which is supported, behind the blade 3-*c*, by a sharpened support 3*a*-2, like a knife, to allow the passage of the cardboard tubes 1-*a* in the cut zone without obstacles or difficulties.

It should also be said that upon leaving the blade 3-*c*, which operates the cutting, the paper 1-*b* due to its own lightness and minor stiffness opens and separates and may be easily recovered by a pneumatic conveyor, usually composed of a simple suction of a use-specific fan and then sent either to the recovery containers or directly to the mixture preparation zone.

Figure 5:
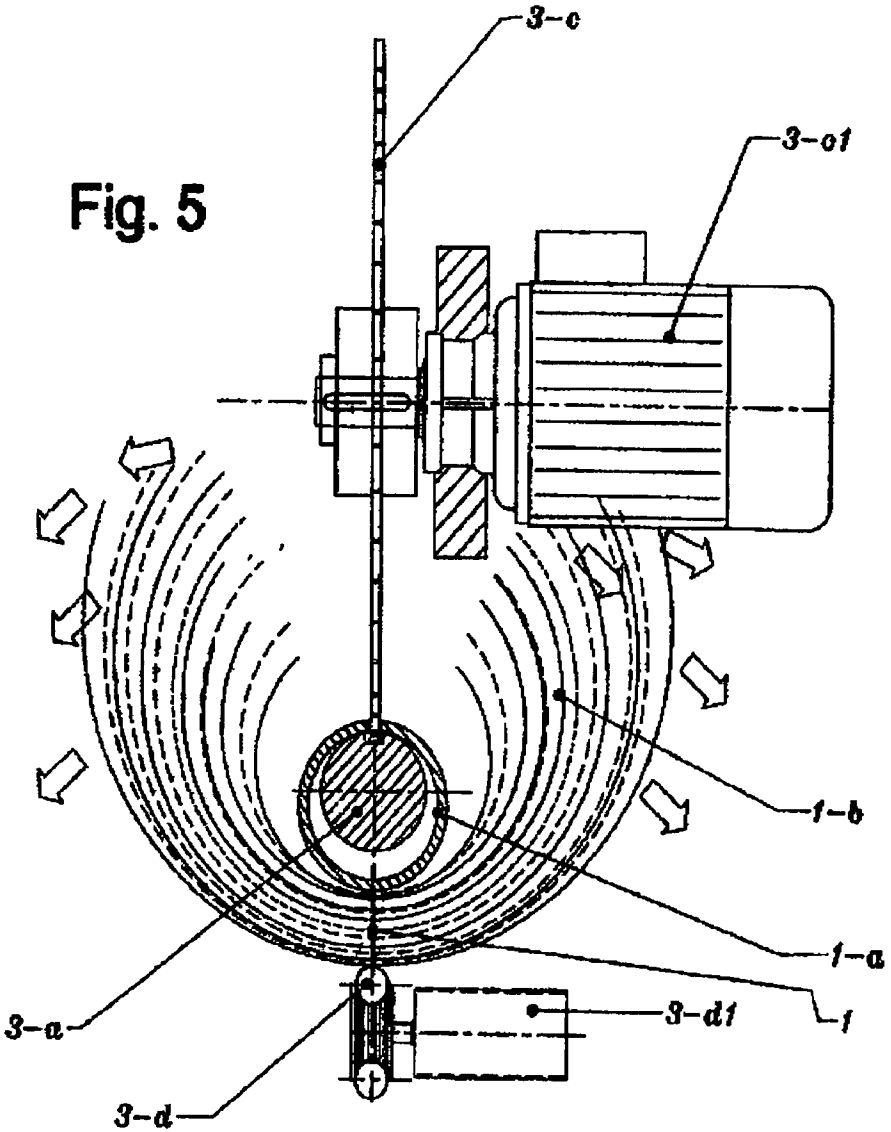
FIG. 5 is a front view, partially sectioned, at 90.degrees with respect to FIG. 4.

FIG. 5 shows the final cutting zone in section, with the motorised belt 3-*d* in support of the trimming rolls 1, the paper 1-*b* and the cardboard tubes 1-*a* which remains "clinging" to the curved bar 3-*a*, sustained by the sharpened support 3-*a*2 while the paper 1-*b* opens as just described.

It is obvious that simple technical-constructive type modifications do not modify the mode of operation of the present machine, which inherently keeps the tube or core 1-*a* on the curved bar 3-*a* while it lets the pure cellulose paper 1-*b* fall and be separately recovered.

Thus one understands how according to the invention, a machine is realized which is intended to separate but above all recover the pure cellulose paper contained in the trimming or selvage rolls of the cutting of reels of paper for the production for domestic or sanitary use, separating it in a secure manner from the tube contained in the centre, which is called the core. This core is made of rather low-quality cardboard, thus it is not possible to reuse it together with the paper, and furthermore there also exist many sizes of these trimming rolls, with diverse diameter and length.

The present machine makes use of an ordering system of these rolls and therefore, with the axis placed vertically, causes the rolls to descend one by one, inserting a guide bar at the centre of the tube hole which leads the rolls toward a cutting system along the generatrix of the roll cylinder, operating now with the roll axis horizontal, and containing it slightly from below, and one obtains, once core and paper are cut, always along the generatrix, that the paper falls and the core remains supported on the above mentioned guide bar, until it moves outside the machine itself, permitting the recovery of the valuable or cellulose paper with a normal pneumatic conveyor system.

Thus the new and inventive technical solutions of the invention are quite evident, as are its advantages.

The invention claimed is:

1. Machine for the automatic recovery of paper and cardboard obtained from separation of front and/or end trimming rolls into cellulose paper and a tubular cardboard core, wherein the front and/or trimming rolls are generated during cutting of logs into rolls, the machine comprising a conveyor comprises a conveyor belt and a sorter for arranging the front and/or end trimming rolls one after the other into an aligned position so as to have an axis perpendicular to the conveyor belt, the conveyor system directing the aligned trimming rolls towards an insertion device for the insertion into a drop cutting group, wherein the drop cutting group comprises, an L-shaped curved centering guide bar having a vertical end portion, a curved central portion and engages the tubular cardboard core of the front and/or end trimming rolls incoming from the insertion device and guides the front and/or end trimming rolls through the curved part towards a horizontal part at which a cutting blade is placed so as to perform a cut, along a longitudinal axis of incoming trimming rolls, the cutting blade being inserted in a slot of the horizontal part of the bar in order to execute a half-roll cut of the paper and cardboard core of the incoming trimming rolls, wherein the machine further comprises a pneumatic suction-conveyor system which acts on the cut paper, the incoming trimming rolls being supported below and externally during the cutting by a belt which advances in the same direction as the cutting.

2. Machine according to claim 1, characterised in that the drop cutting group with L-shaped curved bar is connected and sustained by a vertical blade connected to the machine frame, the L-shaped curved bar being intended to guide the rolls toward the cutting blade and to sustain the cut cardboard cores until they reach the unloading zone outside the machine.

3. Machine according to claim 1, characterised in that the drop cutting group comprises a pneumatic guide group made of one or two actuators for temporarily stopping the descent of the trimming rolls towards the cutting blade.

4. Machine according to claim 2, characterised in that the cutting blade has an edge inserted within the horizontal portion of the L-shaped curved bar the cutting blade simultaneously cutting both the pure cellulose paper and the cardboard core of said trimming rolls.

5. Machine according to claim 1, possessing at its outlet a pneumatic suction or conveyor system for the withdrawing and separating the pure cellulose paper from the cardboard tubular core.

6. Machine according to claim 1, characterised in that it possesses two separate outlets, one for the pure cellulose paper and one for the cardboard cores directly on the L-shaped curved bar.

* * * * *